US006871892B2

(12) United States Patent
Holman

(10) Patent No.: US 6,871,892 B2
(45) Date of Patent: Mar. 29, 2005

(54) APPARATUS TO LOCK AND UNLOCK SCAFFOLD CASTERS

(76) Inventor: Douglas A. Holman, 1816 River Bend Rd., Sevierville, TN (US) 37876

( * ) Notice: Subject to any disclaimer, the term of this patent is extended or adjusted under 35 U.S.C. 154(b) by 0 days.

(21) Appl. No.: 10/101,469

(22) Filed: Mar. 20, 2002

(65) Prior Publication Data

US 2003/0006620 A1 Jan. 9, 2003

Related U.S. Application Data

(60) Provisional application No. 60/303,515, filed on Jul. 9, 2001.

(51) Int. Cl.[7] ..... A47F 13/06

(52) U.S. Cl. ..... 294/19.1; 294/24; 182/17

(58) Field of Search ..... 294/19.1, 24, 49, 294/51, 57, 60; 172/371; 182/15, 17

(56) References Cited

U.S. PATENT DOCUMENTS

| | | | | | |
|---|---|---|---|---|---|
| 341,715 | A | * | 5/1886 | Allen | 294/22 |
| 933,227 | A | * | 9/1909 | Billau | 7/114 |
| 1,211,655 | A | * | 1/1917 | Adams et al. | 172/380 |
| 1,845,222 | A | * | 2/1932 | Birn | 172/371 |
| 2,084,617 | A | | 6/1937 | Kehl | 81/3 |
| 2,275,903 | A | | 3/1942 | Hermann | 294/19 |
| 2,278,111 | A | | 3/1942 | Kleinpell | 240/6.46 |
| 2,279,324 | A | * | 4/1942 | Julien | 294/57 |
| 3,072,428 | A | | 1/1963 | Johnson | 294/2 |
| 3,150,460 | A | | 9/1964 | Dees | 43/4 |
| 3,861,731 | A | | 1/1975 | Young | 294/19 R |
| 4,004,539 | A | | 1/1977 | Wesson | 114/221 |
| 4,750,252 | A | | 6/1988 | Homeyer | 29/426.6 |
| 5,799,996 | A | * | 9/1998 | Fredrickson | 294/51 |
| 6,305,119 | B1 | * | 10/2001 | Kacak | 43/17.2 |

* cited by examiner

*Primary Examiner*—Eileen D. Lillis
*Assistant Examiner*—Michael Lowe
(74) *Attorney, Agent, or Firm*—Richard C. Litman

(57) ABSTRACT

An apparatus used as a tool, to lock and unlock the casters of a scaffold while the user is on top of a scaffold. The apparatus is an elongated pole and adjustable sleeve with a spring-loaded push button mechanism, to change the length of the apparatus. There are a variety of specially designed heads that are used to adjust the scaffold caster levers in locked and unlocked positions. This is done in place of a user climbing up and down the scaffold and manually locking and unlocking the scaffold caster levers from the ground level. A rubber mallet head or contact bulb is provided near the handle to further adjust the scaffold casters, and a looped strap is also provided to hang the apparatus when not in use.

1 Claim, 8 Drawing Sheets

APPARATUS TO LOCK AND UNLOCK SCAFFOLD CASTERS

CROSS-REFERENCE TO RELATED APPLICATION

This application claims the benefit of U.S. Provisional Patent Application Ser. No. 60/303,515, filed Jul. 9, 2001.

BACKGROUND OF THE INVENTION

1. Field of the Invention

The present invention relates to an apparatus to lock and unlock scaffold casters while a user is standing on a scaffold platform.

2. Description of Related Art

Pole extension devices that are used to make adjustments in hard to reach places are well known. The related art reflects numerous inventions that are simply an extension of a person or a tool to perform a particular task. There are an extremely broad range of tools and circumstances that utilize a simple extension pole with a tool or some other implement to more easily perform a particular distant task.

U.S. Pat. No. 2,084,617 issued to Kehl outlines the use of an extension that is used to do work with high voltage operating switches and fuse cut-outs. The extension serves as a safety device that can keep a user a safe distance from such electrical hazards and dangerous flashes. This device is more commonly known as a switch hook and is really just an elongated pole with variety of hooks on the end of the pole used to activate high voltage switches.

U.S. Pat. No. 2,275,903 issued to Hermann similarly outlines the use of a maintenance tool for removing and attaching removable covers for fuse cutouts. Specifically, the tool is made up of an elongated handle with a specially designed wire loop shaped hook to safely remove the cover of the fuse cutout casing at a distance. This is done in lieu of having a person service the fuse cutout by hand using insulated rubber gloves, which is substantially more dangerous than using the described tool.

U.S. Pat. No. 2,278,111 issued to Kleinpell outlines an elongated tool used for releasing the air pressure release bars of a set of elevator doors. Specifically, the tool is used to engage the lock hook for the air pressure release bar that controls the opening of the elevator doors. This air pressure release bar must be opened first in order to open the elevator doors by hand. The tool utilizes a telescoping handle with a small electric lamp being contained at the end of the tool with a switch and an electric circuit being contained within the tool itself.

U.S. Pat. No. 3,150,460 issued to Dees outlines the use of an elongated telescoping handle device with a variety of implements that can be used as a fishing device. These implements include a gig (a two pronged spear), a gaff (a single pronged hook) or a landing net. There is also an external knurling or high friction grip on the handle of the device for easier gripping.

U.S. Pat. No. 3,072,428 issued to Johnson outlines the use of a pole with a spring-loaded telescopic sleeve that is used by loggers in the logging industry. Specifically, this device is known as a pike pole and also provides a boat hook for a combination boat hook and pike pole. The prongs for both the pike pole and boat hook can be sheathed or be retracted depending on the needs of the user. U.S. Pat. No. 3,861,731 issued to Young and U.S. Pat. No. 4,004,539 issued to Wesson also describe the use of several modified boat hooks as well.

U.S. Pat. No. 4,750,252 issued to Homeyer outlines the use of a pry bar and elongated rod with a closed C-shaped jaw member that installs twist-on rod guides onto and off of sucker rods used in secondary oil recovery well equipment. The elongated rod is used to produce enough torque to adequately change the adjustable twist-on rod guides.

The related art describes several situations where an elongated tool or implement would greatly benefit the user. One situation that has not been addressed has been the use of an elongated tool to lock and unlock scaffold casters while working from a scaffold deck. This can be a time-saving device, since presently a worker must climb down off the scaffold to set and reset the casters each time the scaffold is moved. He must do so many times if the work area is larger than the base of the scaffold. What is really needed is an elongated device that can easily lock and unlock scaffold casters without having to climb down and then back up the scaffold.

None of the above inventions and patents, taken either singly or in combination, is seen to describe the instant invention as claimed.

SUMMARY OF THE INVENTION

The invention is an apparatus to lock and unlock the casters of a scaffold while the user is on top of the scaffold. The apparatus is an elongated pole and adjustable sleeve with a spring-loaded push button mechanism to change the length of the apparatus. There are also a variety of specially designed heads that are used to adjust the caster levers in locked and unlocked positions. This is done in place of a user getting off and going from leg to leg on the scaffold and manually locking and unlocking the caster levers, then climbing back on the scaffold. A rubber mallet head or contact bulb is provided near the handle to further adjust the scaffold casters. A looped strap is also provided to hang the apparatus when not in use.

Accordingly, it is a principal object of the invention a user to lock and unlock casters of a scaffold from the top of the scaffold, without having to do the time consuming and potentially dangerous task of climbing up and down the scaffold and adjusting the scaffold casters by hand at ground level.

It is another object of the invention to provide an apparatus which allows a user to more safely lock and unlock the casters of a scaffold.

It is a further object of the invention to provide an apparatus which allows a user to easily adjust the length of the apparatus used to lock and unlock scaffold casters.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
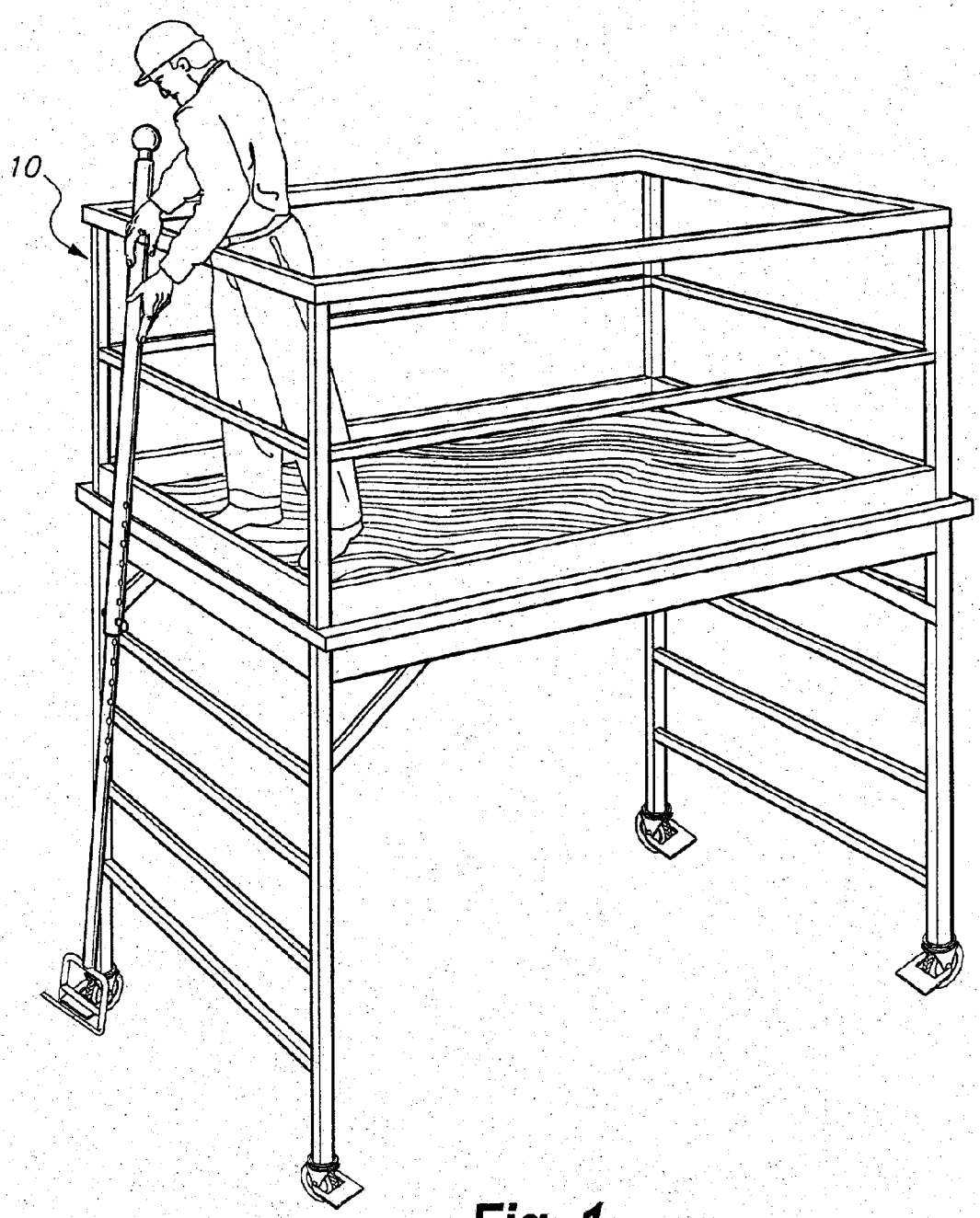
FIG. 1 is an environmental, perspective view of an apparatus to lock and unlock scaffold casters according to the present invention.

The present invention is an apparatus 10 used as a tool, to lock and unlock a scaffold caster while a user is on a scaffold platform, as depicted in FIG. 1.

Figure 2:
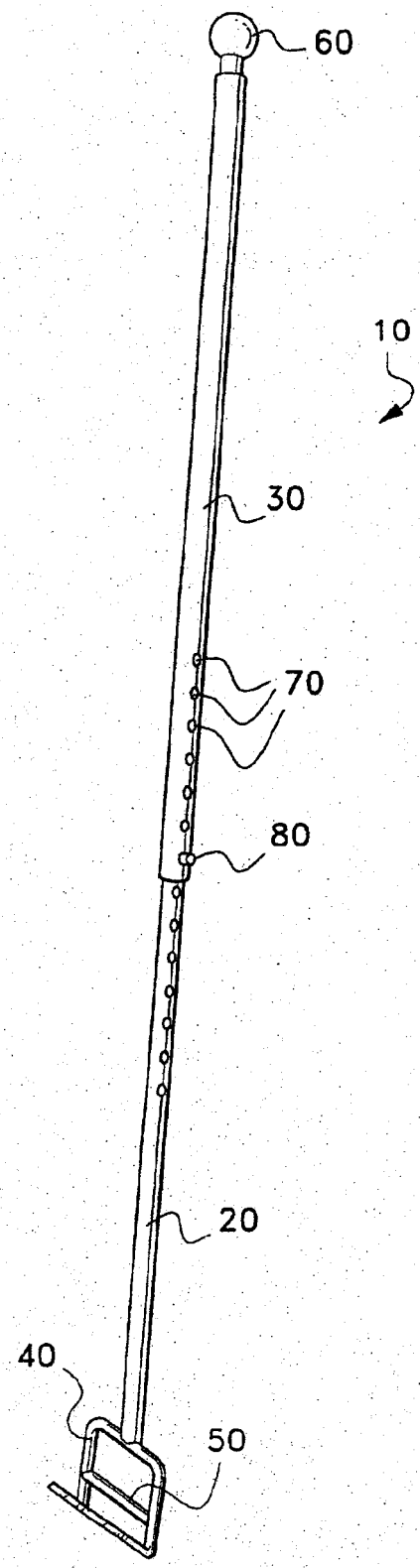
FIG. 2 is a perspective side view of a scaffold caster adjuster as shown in FIG. 1.

As shown in FIG. 2, the first embodiment of the apparatus 10 comprises an elongated pole 20 with an adjustable sleeve 30 mounted over the elongated pole 20, a length adjuster for selectively adjusting the position of the sleeve 30 relative to the elongated pole 20, a bevelled head 40 and bar 50 at the lower portion of the elongated pole 20 to engage a variety of scaffold caster levers that can be manipulated to lock and unlock each scaffold caster of a scaffold, and a contact bulb 60 at the upper portion of the elongated pole 20, used to adjust scaffold caster into a proper position.

The length adjuster for setting the position of the sleeve 30 relative to the elongated pole 20 comprises a plurality of holes 70 formed on the sleeve 30 and a spring-loaded push button 80 designed to fit within one of the holes to hold the sleeve 30 relative to the elongated pole 20. The structure and use of this particular length adjuster is well known.

The bevelled head 40 and bar 50 are designed to catch a lever from each scaffold caster on the scaffold. The current practice of most scaffold users is to climb off the scaffold after working on a small section of their work from the scaffold, unlocking, moving the scaffold and locking the scaffold casters in place by hand and then climbing back onto the scaffold. This can cause the scaffold to tip over if done incorrectly, and is extremely tedious for the person working on the scaffold, particularly if there is a lot of area to cover.

Figure 3:
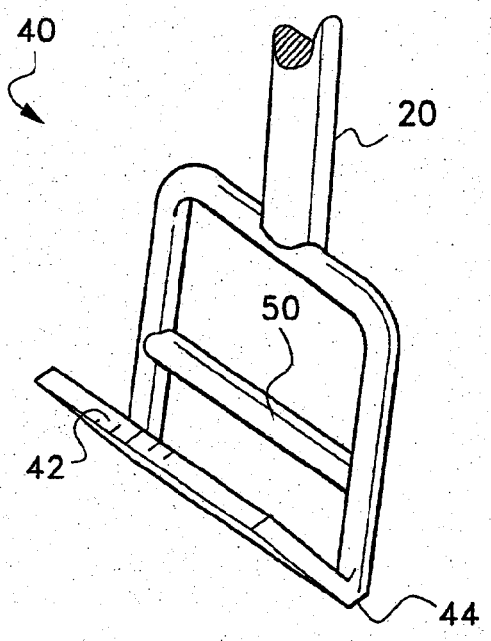
FIG. 3 is an enlarged scale, perspective view of the preferred embodiment of the adjusting head of a scaffold caster adjuster as seen in FIGS. 1 and 2.

As shown in FIG. 3, the edge 42 of the bevelled head 40 is designed to catch a scaffold caster lever that is pointing down to the ground. This design allows the edge 42 to get under the downward lever and maneuver the lever upwards, thereby locking or unlocking the scaffold caster. This design also allows the end 44 of the bevelled edge 42 to maneuver a scaffold caster lever that is pointing upwards and to push the lever downward, thereby also locking or unlocking the caster. A bar 50 is also provided on the bevelled head 40 to accommodate a scaffold caster lever that is parallel to the ground.

Different scaffold casters have different positions for being locked and unlocked. However, the specially designed bevelled head 40, like all of the different embodiments of the apparatus 10, can be used to easily maneuver scaffold casters from many angles into a locked or unlocked position, all from the top of the scaffold.

Figure 4:
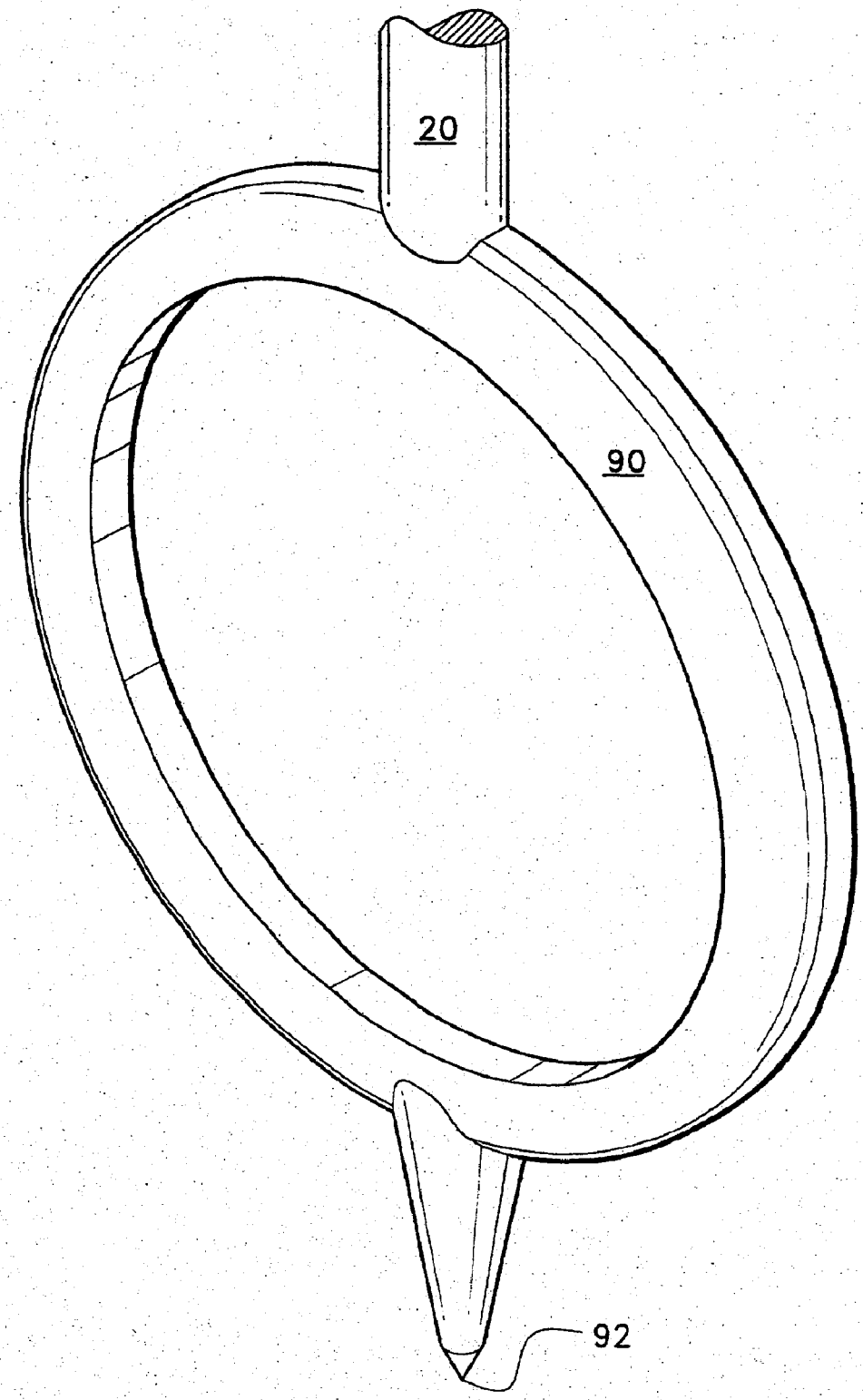
FIG. 4 is a perspective view of a second embodiment of an adjusting head of a scaffold caster adjuster.

There are other embodiments that utilize a number of different shaped heads and handles. For example, FIG. 4 depicts an embodiment of the apparatus 10 where an open circular ring 90 and pointed tip 92 are at the end of the elongated pole 20 to engage a variety of levers that can be manipulated to lock and unlock each scaffold caster of a scaffold.

Figure 5:
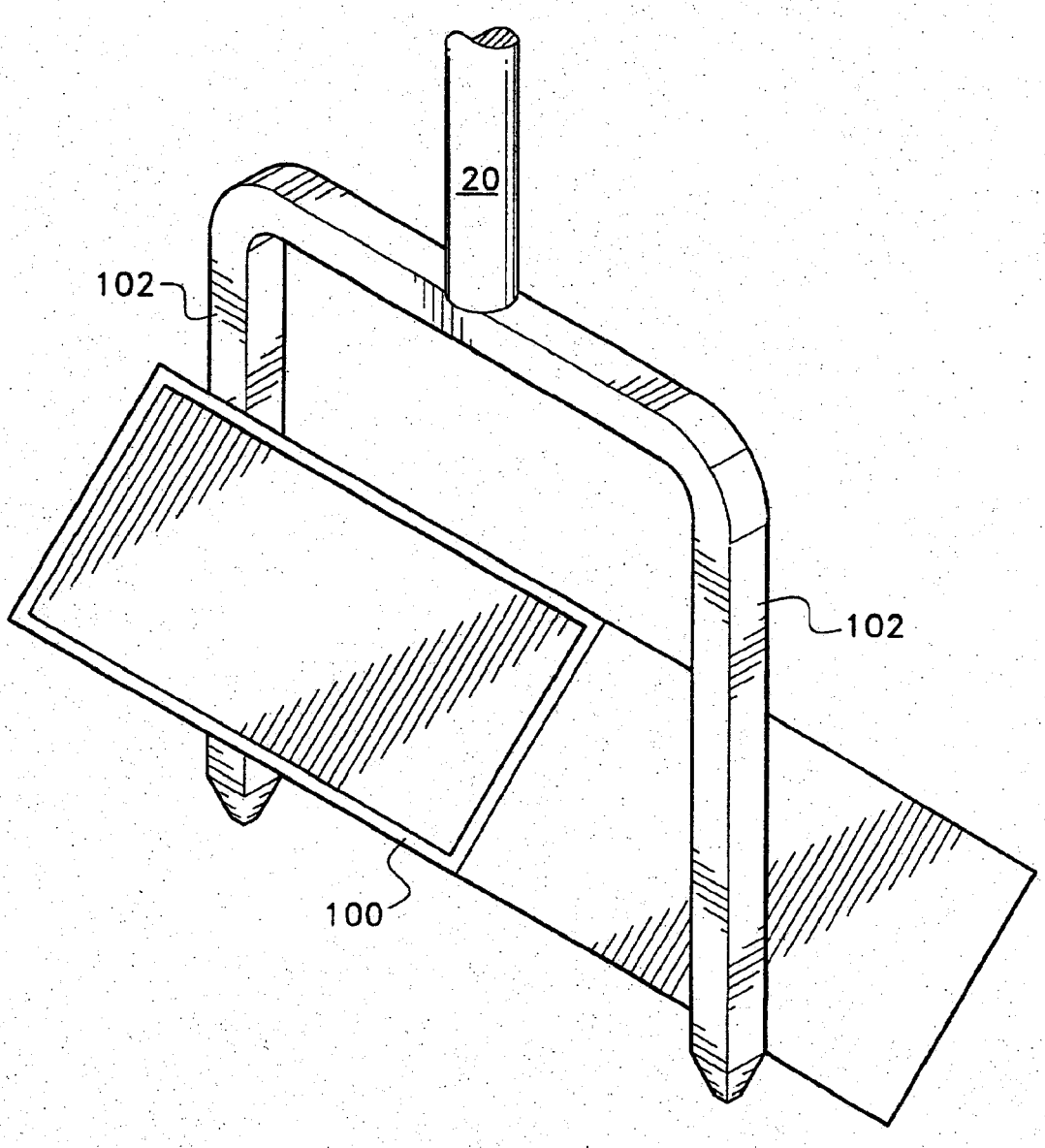
FIG. 5 is a perspective view of a third embodiment of an adjusting head of a scaffold caster adjuster.

FIG. 5 shows an embodiment that uses another differently shaped head. A movable open-ended rectangular box 100 is at the end of the elongated pole 20 to engage a variety of levers that can be manipulated to lock and unlock each scaffold caster of a scaffold. The open-ended rectangular box 100 is pivotally attached to the inside of each prong 102.

Figure 6:
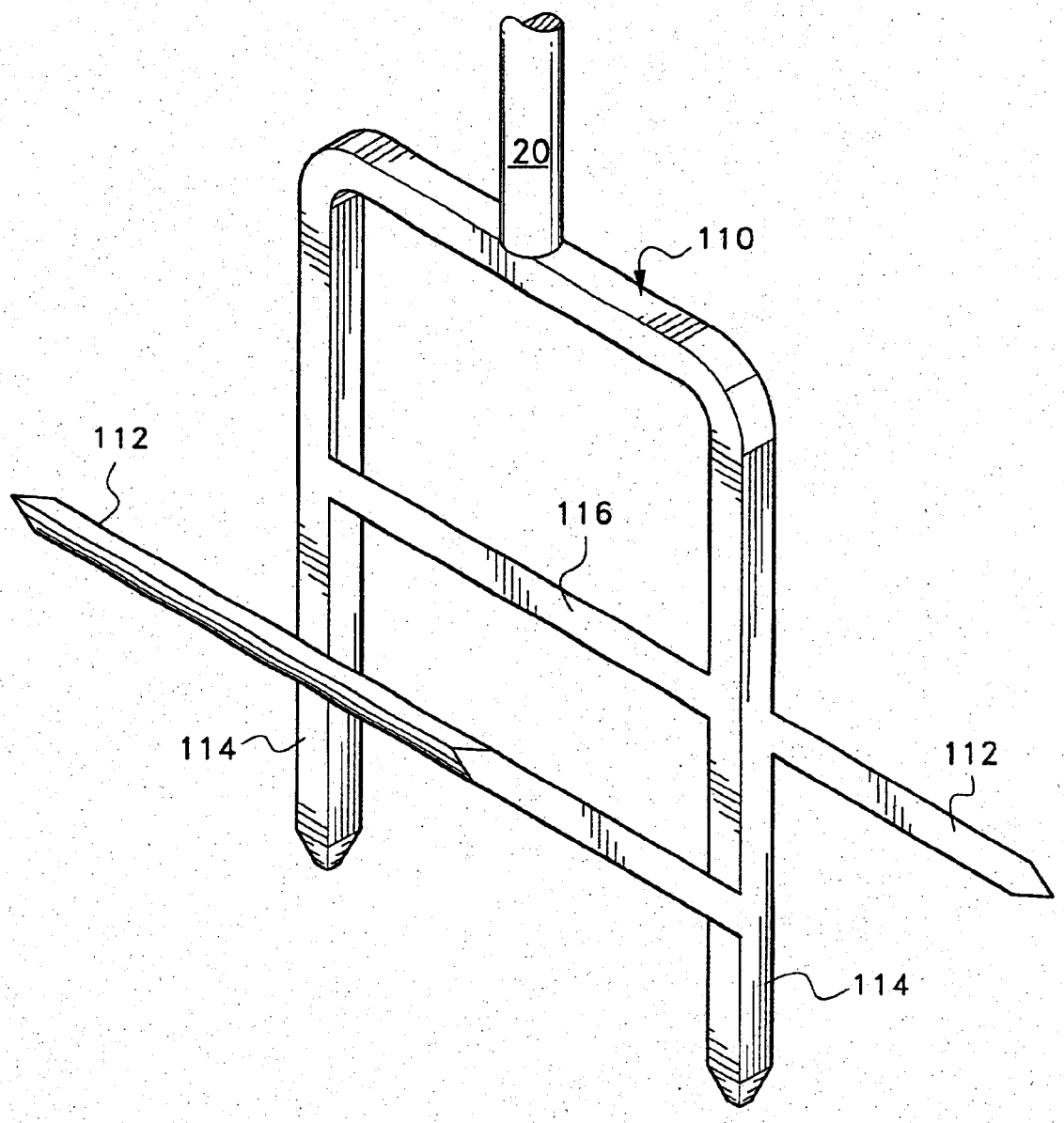
FIG. 6 is a perspective view of a fourth embodiment of an adjusting head of a scaffold caster adjuster.

FIG. 6 illustrates an embodiment of the apparatus 10 where a double pronged fork 110 with an additional tines 112 on each prong 114 of the fork 110 are at the end of the elongated pole 20 to engage a variety of levers that can be manipulated to lock and unlock each scaffold caster of a scaffold. There is also a horizontal bar 116 that is placed between the prongs 114, to further enhance the versatility of the apparatus 10 in catching a lever of a scaffold caster.

Figure 7:
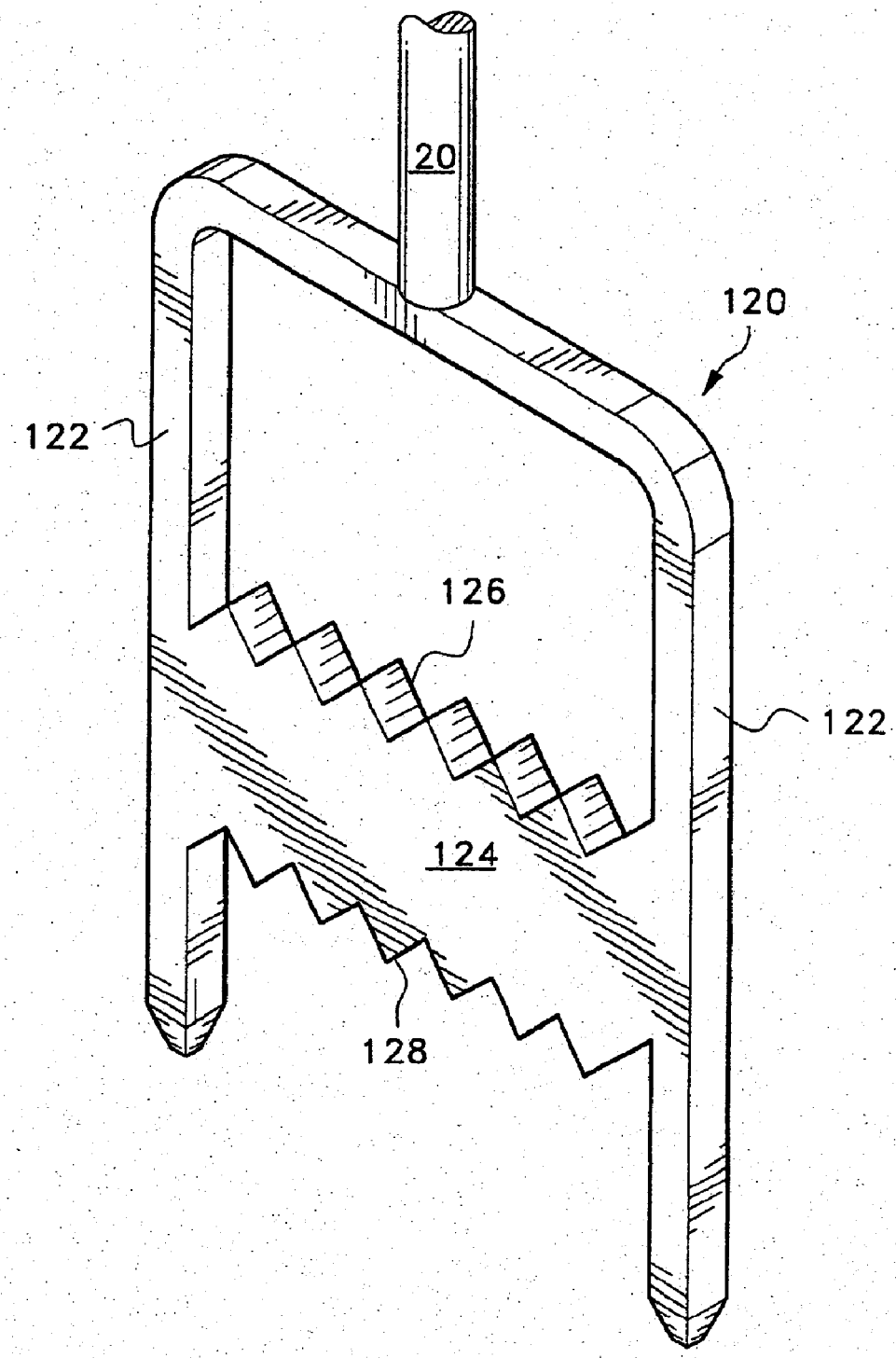
FIG. 7 is a perspective view of a fifth embodiment of an adjusting head of a scaffold caster adjuster.

FIG. 7 shows another embodiment of the apparatus 10 where a horizontal piece 124 is provided between each prong 122 of a double pronged fork 120 with serrated top and bottom edges 126 and 128 at the end of the elongated pole 20 to engage a variety of levers that can be manipulated to lock and unlock each scaffold caster of a scaffold.

Figure 8:
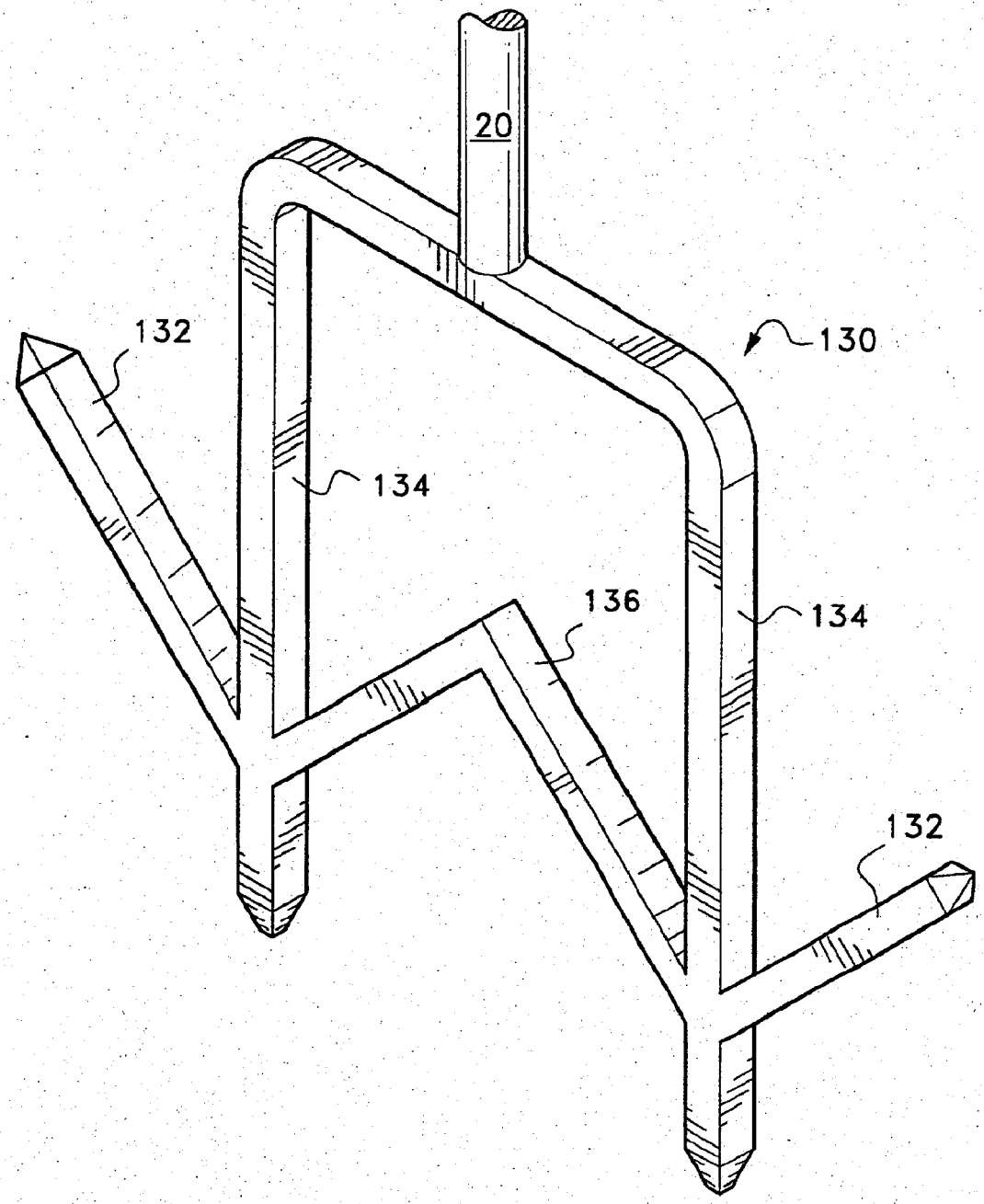
FIG. 8 is a perspective view of a sixth embodiment of an adjusting head of a scaffold caster adjuster.

FIG. 8 depicts another embodiment of the apparatus 10 where a double pronged fork 130 with angled protruding tines 132 on each prong 134 of the fork 130 are at the end of the elongated pole 20 to engage a variety of levers that can be manipulated to lock and unlock each caster of a scaffold. An additional bent angle horizontal piece 136 is provided between the prongs 134 of the fork 130 to further enhance the chance of the fork 130 catching the lever of a scaffold caster.

Figure 9:
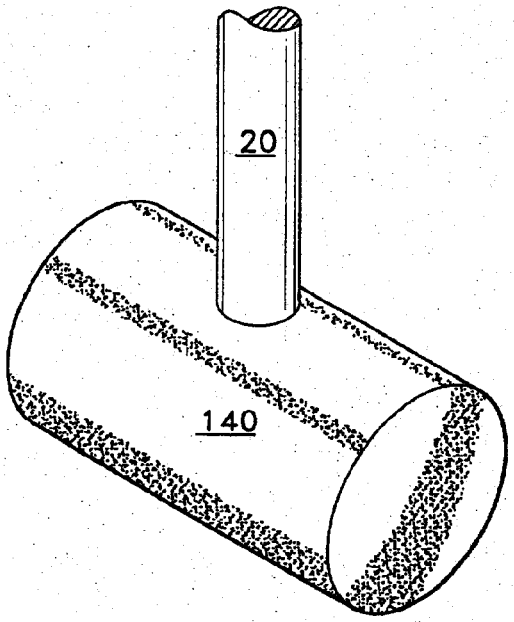
FIG. 9 is a perspective view of a mallet head on the handle of the scaffold caster adjuster.
Figure 10:
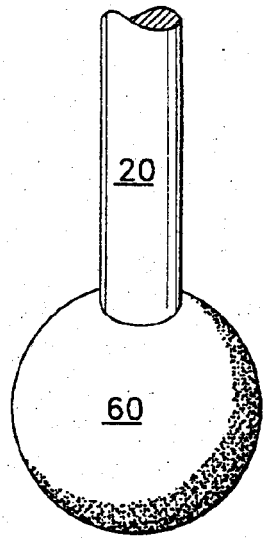
FIG. 10 is a perspective view of a contact bulb on the handle of another scaffold caster adjuster.
Figure 11:
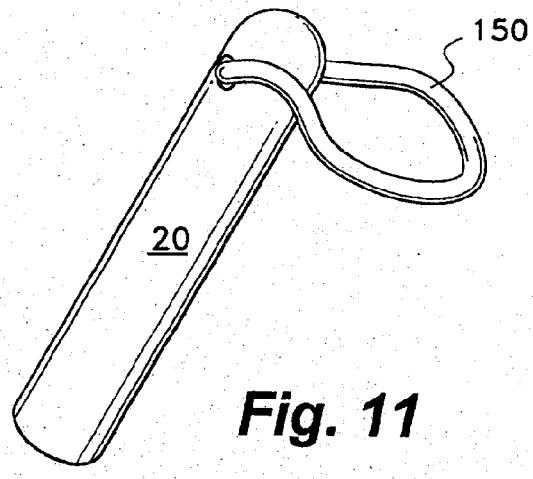
FIG. 11 is a perspective view of an attachment loop on the handle of a scaffold caster adjuster.

FIG. 9 illustrates a mallet head 140 at the upper portion of the elongated pole 20, in place of the contact bulb 60, but used for the same purpose. The contact bulb 60 is shown in the enlarged scale view of FIG. 10. Additionally, as seen in FIG. 11, a strap is formed into a loop 150 near the upper portion of the elongated pole 20, to assist a user in hanging the apparatus 10 when not in use.

The Code of Federal Regulations (29 CFR Part 1926.452 (W)) must be followed when using this device, as well as any state or local regulations that are applicable, regarding the use of any scaffold.

Operation of the apparatus 10 is uncomplicated. A user will use the apparatus 10 from the top of a scaffold to lock and unlock the scaffold caster levers used to hold the scaffold in place. The adjustable elongated pole 20 makes it easy to reach the scaffold caster levers to lock and unlock the scaffold caster levers. The elongated pole 20, adjustable sleeve 30 and various shaped heads of the apparatus 10 are made of metal or aluminum, while the contact bulb 60 or the mallet head 140 of the apparatus 10 are made of solid rubber. The elongated pole 20, adjustable sleeve 30 and bevelled head 40 may also be made of non-conductive materials for greater safety during work near high voltage projects.

It is to be understood that the present invention is not limited to the embodiments described above, but encompasses any an all embodiments within the scope of the following claims.

I claim:

1. An apparatus for assisting a user to lock and unlock scaffold casters while the user is on a scaffold, consisting essentially of:

an elongated pole having a lower portion and an upper portion;

said upper portion including an adjustable sleeve mounted over said lower portion;

an adjuster coupled to said lower portion for selectively adjusting the position of the sleeve relative to said lower portion;

said adjuster for selectively adjusting the position of the sleeve relative to the elongated pole comprises a plurality of holes formed on the adjustable sleeve and a spring-loaded push button fit within one of the holes to hold the sleeve relative to the lower portion;

a head member coupled to the lower portion of said elongated pole, and designed and configured to selectively lock and unlock a caster lever of a scaffold caster;

said head member includes a U-shaped frame fixedly attached at the lower portion of the elongated pole, said U-shaped frame having legs extending along a single plane and supporting a plate with a bevelled head at a far end of the legs, said plate extending upwards at an acute angle relative said legs and a bar that connects the legs at an intermediate point thereof, said beveled head includes a first edge and a second edge, said first edge of said beveled head being designed and configured to manipulate a downwardly directed caster lever upward, and said second edge of said beveled head being designed and configured to manipulate an upwardly directed caster lever downward;

said bar being designed and configured to engage a caster lever extending outwardly from the caster, parallel with the ground surface; and a contact member disposed at an end of the upper portion of the elongated pole, said contact member being used to adjust the scaffold casters into desired position;

wherein the length of the elongated pole is variably adjustable when the sleeve of the upper portion is selectively positioned relative to the lower portion, via said adjuster, at a plurality of positions, and wherein said head member is designed and configured to engage a variety of levers to be manipulated for locking and unlocking each of the scaffold casters of the scaffold.

* * * * *